US011110029B2

(12) United States Patent
Xie et al.

(10) Patent No.: US 11,110,029 B2
(45) Date of Patent: Sep. 7, 2021

(54) CLAW MASSAGE APPARATUS

(71) Applicant: XIAMEN SOLEX HIGH-TECH INDUSTRIES CO., LTD., Xiamen (CN)

(72) Inventors: Peng Xie, Xiamen (CN); Hailang Gong, Xiamen (CN); Mingfu Zhang, Xiamen (CN); Wenxing Chen, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 407 days.

(21) Appl. No.: 16/114,161

(22) Filed: Aug. 27, 2018

(65) Prior Publication Data

US 2019/0192376 A1 Jun. 27, 2019

(30) Foreign Application Priority Data

Dec. 22, 2017 (CN) ..... 201711406156.X
Dec. 22, 2017 (CN) ..... 201721826801.9

(51) Int. Cl.
*A61H 15/00* (2006.01)
*A61H 1/00* (2006.01)

(52) U.S. Cl.
CPC ..... *A61H 15/0078* (2013.01); *A61H 1/00* (2013.01); *A61H 2015/0028* (2013.01);
(Continued)

(58) Field of Classification Search
CPC ..... A61H 7/00; A61H 7/002; A61H 7/003; A61H 7/004; A61H 7/005; A61H 7/007;
(Continued)

(56) References Cited

U.S. PATENT DOCUMENTS

2014/0008462 A1* 1/2014 Gransow ..... B05B 1/12 239/391
2016/0228887 A1* 8/2016 Lin ..... B05B 3/0418
(Continued)

FOREIGN PATENT DOCUMENTS

CN 102806156 A 12/2012
CN 204544503 * 8/2015 ..... A47K 7/02
(Continued)

OTHER PUBLICATIONS

CN204544503 EPO and Google Machine translation (Year: 2020).*
The JP1OA dated Dec. 10, 2019 by the JPO.

*Primary Examiner* — Kendra D Carter
*Assistant Examiner* — Eric Theisen
(74) *Attorney, Agent, or Firm* — Qinghong Xu

(57) ABSTRACT

The present disclosure provides a claw massage apparatus including a drive mechanism, a transmission mechanism, a base and a plurality of massage mechanisms. The drive mechanism may drive rotation of the transmission mechanism, and the transmission mechanism is provided with a moving rail. The transmission mechanism is rotatably connected to the base. The plurality of massage mechanisms includes a connecting part connected to the moving rail in a transmission way and a massage claw positioned outside the base. Wherein the drive mechanism can drive rotation of the moving rail, during the rotation of the moving rail, the respective connecting parts can be pushed to swing, such that the respective massage claws move between the first extreme position and the second extreme position; in a first extreme position, the respective massage claws are close to each other; in a second extreme position, the respective massage claws are distanced from each other.

13 Claims, 15 Drawing Sheets

(52) U.S. Cl.
CPC ..... *A61H 2015/0064* (2013.01); *A61H 2201/1238* (2013.01); *A61H 2201/1669* (2013.01)

(58) Field of Classification Search
CPC .... A61H 7/008; A61H 2007/009; A61H 9/00; A61H 9/0021; A61H 9/0028; A61H 15/0078; A61H 15/0085; A61H 15/0092; A61H 33/00; A61H 33/60; A61H 33/601; A61H 33/6021; A61H 33/6036; A61H 33/6089; A61H 2201/00; A61H 2201/12; A61H 2201/1238; B05B 1/00; B05B 1/14; B05B 1/18; B05B 1/185; B05B 3/00; B05B 3/02; B05B 3/04; B05B 3/0409; B05B 3/0418; B05B 3/0422; B05B 3/0427; B05B 3/0445; B05B 3/0463; A46B 13/00; A46B 13/02; A46B 13/023; A46B 13/026; A46B 13/04; A46B 13/06; A47K 7/00; A47K 7/02; A47K 7/04; A47K 7/043; A47K 7/046
See application file for complete search history.

(56) References Cited

U.S. PATENT DOCUMENTS

| | | | | |
|---|---|---|---|---|
| 2016/0303587 | A1* | 10/2016 | Zhou | B05B 3/04 |
| 2017/0087565 | A1* | 3/2017 | Hou | B05B 15/654 |

FOREIGN PATENT DOCUMENTS

| | | | |
|---|---|---|---|
| CN | 204544503 | U | 8/2015 |
| CN | 204683439 | U | 10/2015 |
| JP | 2014509696 | A | 4/2014 |

* cited by examiner

CLAW MASSAGE APPARATUS

CROSS-REFERENCE TO RELATED APPLICATIONS

This application is based on and claims priority to Chinese Patent Application 201721826801.9 and 201711406156.X, filed on Dec. 22, 2017, the entire contents thereof are incorporated herein by reference.

TECHNICAL FIELD

The present application relates to a massage apparatus.

BACKGROUND

At present, there are many types of massagers that are able to contact with human body to provide massage for the whole or partial body. The massager mainly includes a drive mechanism and a massage mechanism. The drive mechanism is, for example, a battery or an external power source, and the massage mechanism is, for example, a massage claw. The massage mechanism is driven to rotate by means of the drive mechanism, and to contact with the human body, such that massage for the human body can be achieved by utilizing rotation of the massage mechanism.

However the above-mentioned massager can be used merely for pressing the surface of the human body and has a hard massaging action, as a result, it cannot promote blood circulation, its comfort is far less than an effect of manual grasping massage, and thereby not bringing relaxation for a user.

Therefore, how to improve the massage comfort of the massager becomes a urgent technical problem to be solved in the art.

SUMMARY

Based on the above problem, an object of the present disclosure is to provide a claw massage apparatus in order to improve massage comfort.

To achieve the above object, the present disclosure provides a claw massage apparatus including a drive mechanism, a transmission mechanism, a base and a plurality of massage mechanisms.

The drive mechanism may drive rotation of the transmission mechanism, and the transmission mechanism is provided with a moving rail. The transmission mechanism is rotatably connected to the base. The plurality of massage mechanisms includes a connecting part connected to the moving rail in a transmission way and a massage claw positioned outside the base.

Wherein the drive mechanism can drive rotation of the moving rail, during the rotation of the moving rail, the respective connecting parts can be pushed to swing, such that the respective massage claws move between the first extreme position and the second extreme position; in a first extreme positron, the respective massage claws are close to each other; in a second extreme position, the respective massage claws are distanced from each other.

As compared with the prior art, the present disclosure has advantageous effect as follows: in the claw massage apparatus of the present disclosure the massage mechanism swings due to the rotation of the moving rail, such that the respective massage claws move inwardly or outwardly simultaneously, and thereby realizing the grasping motion. Compared with the rotary massage in the related art, the claw massage apparatus of the present application may simulate an effect of manual grasping massage, and the massage power is appropriate, which may promote blood circulation and bring relaxation for the user.

DETAILED DESCRIPTION

Figure 1:
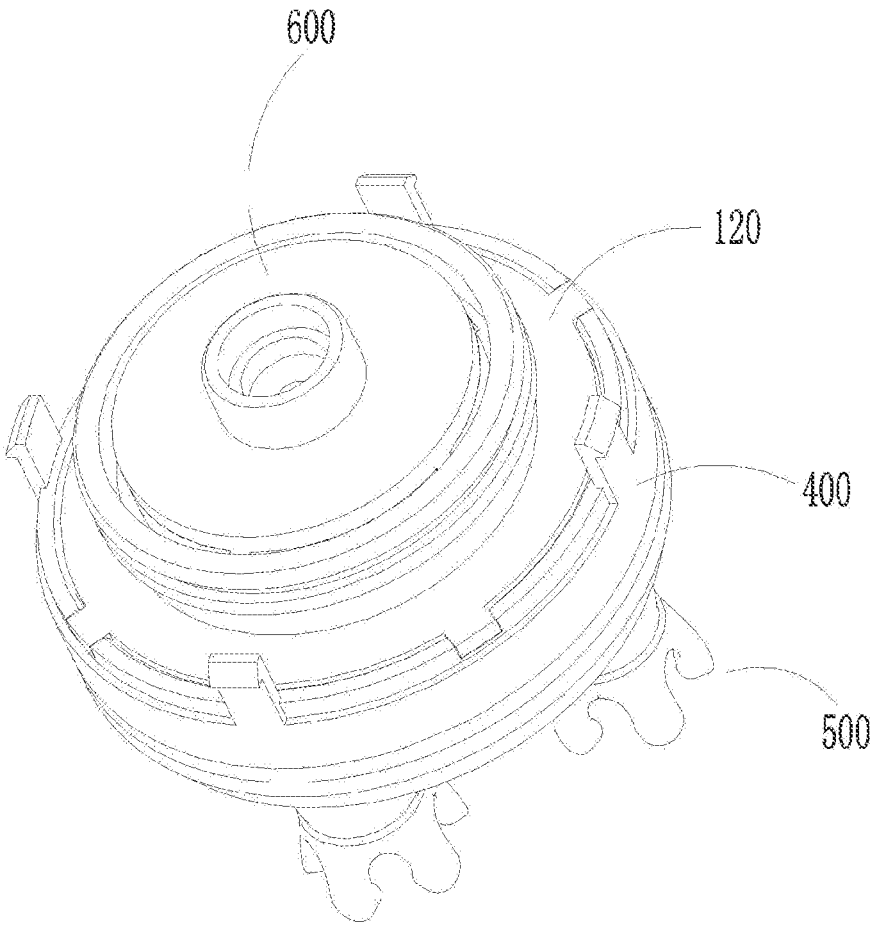
FIG. 1 is a perspective view of a claw massage apparatus according to the first embodiment of the present disclosure.

Now, the exemplary embodiments will be described more fully with reference to the accompany drawings. However, the exemplary embodiments can be implemented in various forms and should not be construed as limited to the embodiments set forth herein. Instead, these embodiments are provided so that the present disclosure will be thorough and complete, and the concept of the exemplary embodiment will fully conveyed to those skilled in the art. In the drawings, for sake of clearness, the thickness of the areas and the layer may be exaggerated. The same reference signs denote the same or similar structures in the accompany drawings, and thus the detailed description thereof will be omitted.

In addition, the foresaid features, structures, or characteristics may be combined in one or more embodiments in any suitable manner. Numerous specific details as above described are provided for fully understanding the embodiments of the present disclosure. However, it will be acknowledged for the person skilled in the art that the technical solutions of the present disclosure practiced without one or more of the specific details, or by using other methods, components, materials, etc. may be employed. In other instances, well-known structures, materials, or operations are not shown or described in detail to avoid obscuring main technical creation of the present disclosure.

The present disclosure provides a claw massage apparatus, as shown in FIGS. 1-4, 7B and 8B, including a drive mechanism 100, a transmission mechanism 200, a base 400, and a plurality of massage mechanisms 500.

The drive mechanism 100 is capable of driving rotation of the transmission mechanism 200, which is provided with a moving rail 300. The transmission mechanism 200 is rotatably connected to the base 400. The plurality of massage mechanisms 500 are supported by the base 400. Each of the massage mechanism 500 includes a connecting part 510 and a massage claw 520. The connecting part 510 of each of the massage mechanisms 500 is connected to the moving rail 300 in a transmission way, and the massage claw 520 is located outside the base 400.

Figure 6:
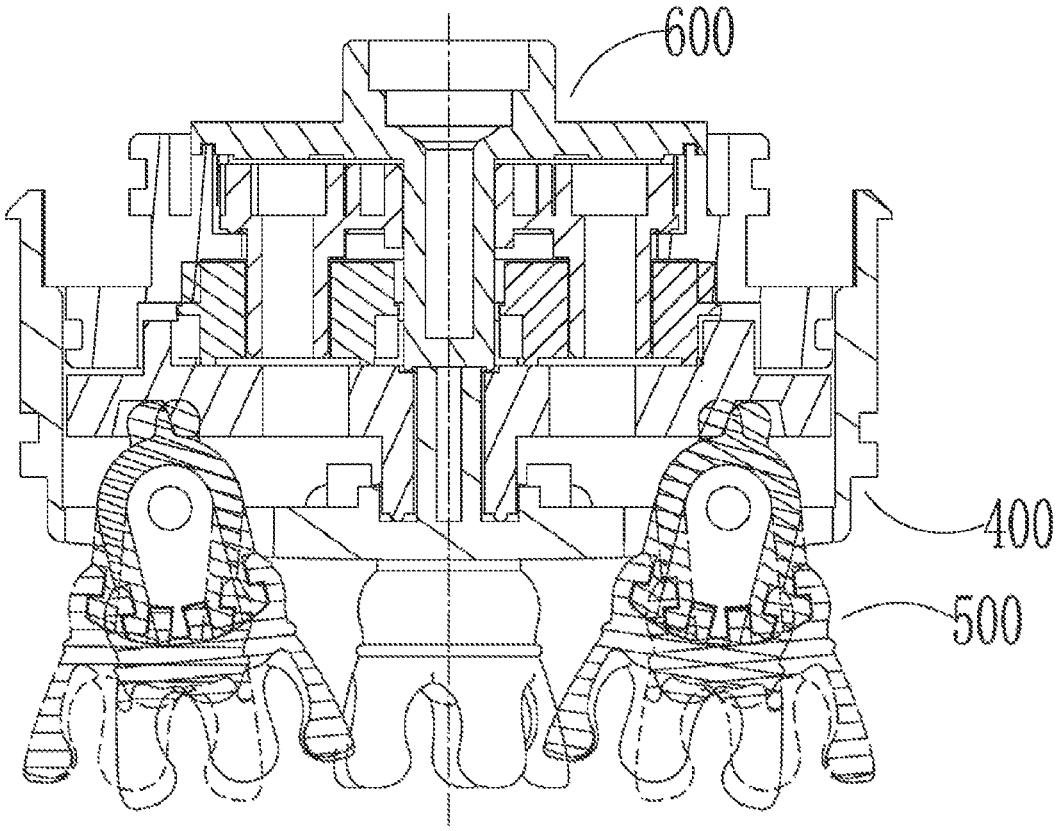
FIG. 6 is a cross-sectional view of the claw massage apparatus according to the first embodiment of the present disclosure, showing the two extreme positions of the massage claw in solid and dotted lines, respectively.

Referring to FIG. 6, during rotation of the moving rail 300, each of the connecting parts 510 may be pushed to swing, so that each of the massage claws 520 moves between a first extreme position and a second extreme position. In the first extreme position, the respective massage claws 520 are close to each other, as shown by a solid line in FIG. 6. In the second extreme position, the respective massage claws 520 are distanced from each other, as shown by a dotted line in FIG. 6. Therefore, a swinging motion in which the respective massage claws 520 are close to each other and distanced away from each other is a grasping motion of the massage claws 520.

Therefore, in the claw massage apparatus of the present disclosure the massage mechanism 500 swings by the rotation of the moving rail 300, such that the respective massage claws 520 move inwardly or outwardly simultaneously, and thereby realizing the grasping motion. Compared with the rotary massage in the related art, the claw massage apparatus of the present application may simulate an effect of manual grasping massage, and the massage power is appropriate, which may promote blood circulation and bring relaxation for the user.

Hereinafter, two embodiment of the specific structure of the claw massage apparatus of the present disclosure will be described in detail.

The First Embodiment

In this embodiment the drive mechanism 100 is in a form of an impeller 110 which is hydraulically driven to rotate, so as to drive rotation of the transmission mechanism 200.

Figure 2:
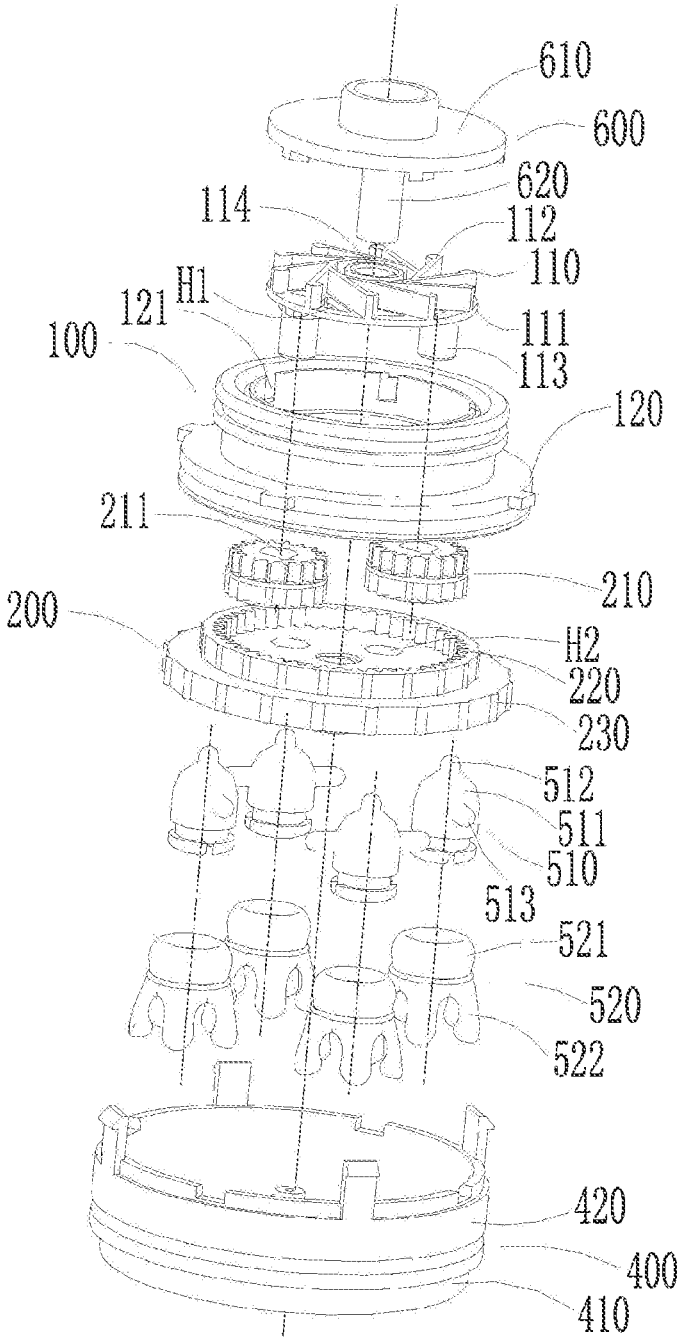
FIG. 2 is an exploded perspective view of the claw massage apparatus according to the first embodiment of the present disclosure.
Figure 3:
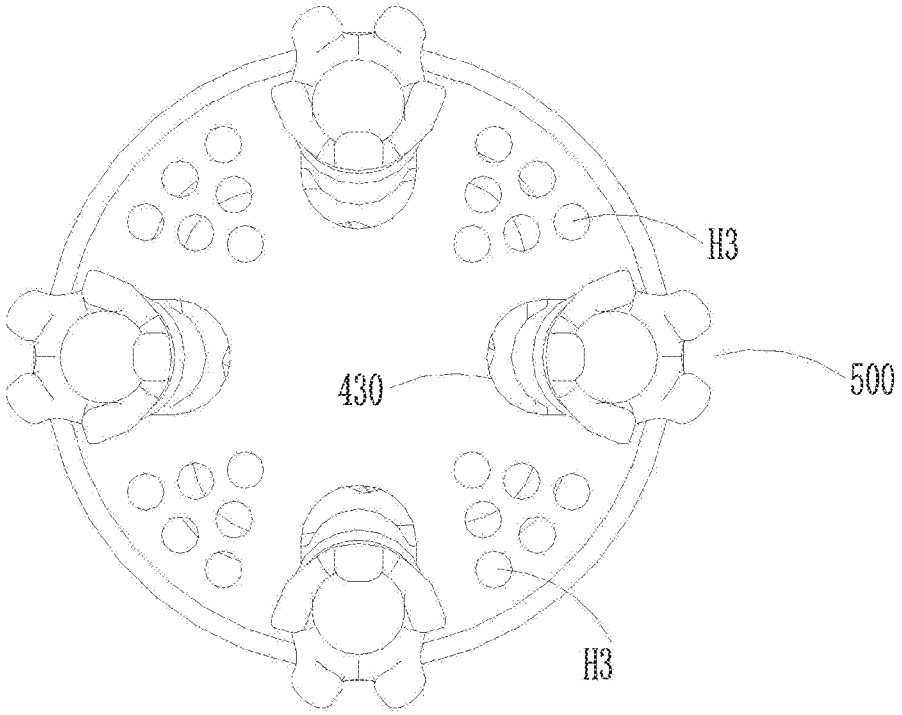
FIG. 3 is a bottom view of the claw massage apparatus according to the first embodiment of the present disclosure.
Figure 4:
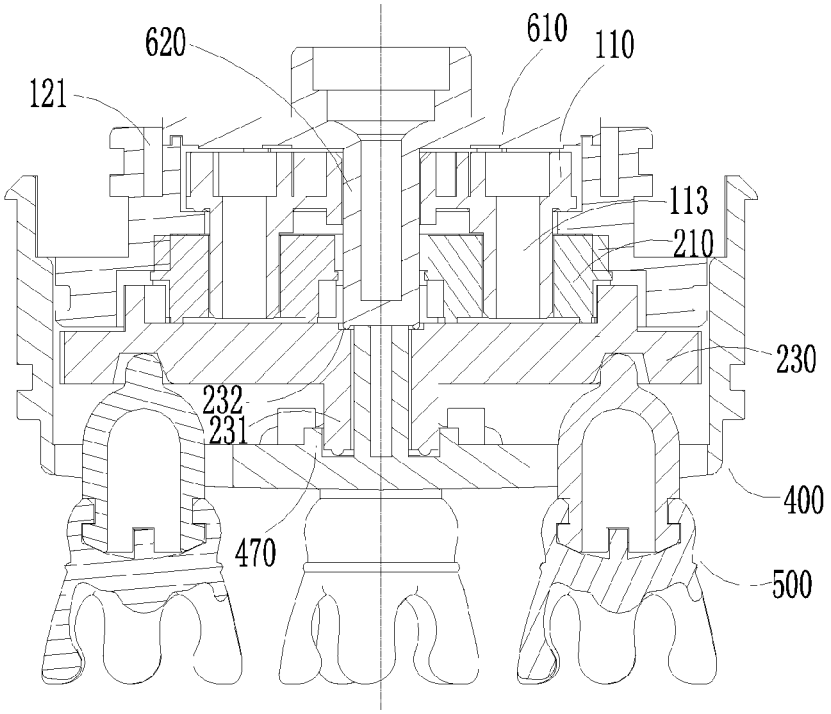
FIG. 4 is a cross-sectional view of the claw massage apparatus according to the first embodiment of the present disclosure.

Particularly, as shown in FIG. 2 and FIG. 4, the drive mechanism 100 includes an impeller 110 and an upper cover 120. The impeller 110 includes a wheel body 111 and blades 112 disposed on the wheel body 111. The wheel body 111 is connected to the transmission mechanism 200 in a transmission way. The upper cover 120 is disposed around the impeller 110, and water inlet holes 121 in communication with the impeller 110 are formed on the upper cover 120.

During operation, the drive mechanism 100 may be connected to a water valve, such as a faucet or a shower switch. After the water valve is opened, a water flow with water pressure may enter the impeller 110 through the water inlet holes 121, and flush the blades 112 to rotate the impeller 110, thereby driving the rotation of the transmission mechanism 200.

In this embodiment, the impeller 110 further includes guide posts 113. The guide posts 113 and the blades 112 are respectively disposed on opposite surfaces of the wheel body 111. The transmission mechanism 200 includes a gear 210, a gear ring 220 and a rail plate 230. The gear 210 is provided with a through shaft hole 211 through which the guide post 113 passes. The gear 210 may engage with the internal teeth of the gear ring 220. The gear ring 220 is fixed to one surface of the rail plate 230. The gear ring 220 and the rail plate 230, for example, are integrally formed. The moving rail 300 is recessed on the other surface of the rail plate 230.

Therefore, the impeller 110, the gear 210 and the gear ring 220 constitute a planetary reduction gear train. The impeller 110 starts to rotate at a high speed under the impact of the water flow, and the guide post 113 formed through the gear 210 drives the rotation of the gear 210, and the rotating gear 210 is decelerated in the planetary gear train, such that the gear ring 220 engaging with the gear 210 rotates at a relatively low speed, and the moving rail 300 and the gear ring 220 rotate synchronously.

As shown in FIG. 2, in this embodiment, there are two guide posts 113 and two gears 210. The guide posts 113 are disposed along a diameter direction of the wheel body 111, and the impeller 110 is rotated around a central axis. It should be understood that the number and the layout of the guide posts 113 and the gears 210 are not limited thereto, and also may be three.

Hereinafter, the form and movement principle of the moving rail 300 will be described in detail.

The moving rail may be defined as a closed track formed by continuously rotating a line around a center, in which the center is a center of the moving rail, the line may be a straight line or a curved line, which may be regular or irregular.

Referring to FIG. 7A to FIG. 8B, in this embodiment, the moving rail 300 is an annular quadrilateral structure surrounded by a concave-convex arc curved line, and the moving rail 300 has smooth corners. The moving rail 300 has a first position P1 and a second position P2. A distance between the first position P1 and the center of the moving rail 300 is the maximum distance, and a distance between the second position P2 and the center of the moving rail 300 is the minimum distance. The first positions P1 and the second positions P2 are in plurality, which are the same in number and spaced apart from one another. In this embodiment, the first positions P1 are at four corners of the square, and the second positions P2 are at a midpoint of the four sides of the square.

Figure 7A:
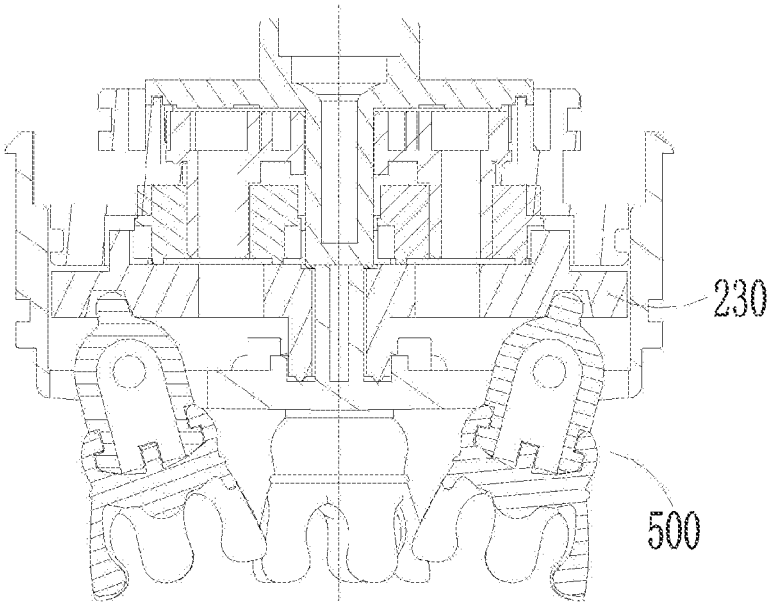
FIG. 7*a* and FIG. 7*b* are respectively a cross-sectional view and a bottom view of the claw massage apparatus according to the first embodiment of the present disclosure, showing that the massage claw is in a first extreme position.
Figure 7B:
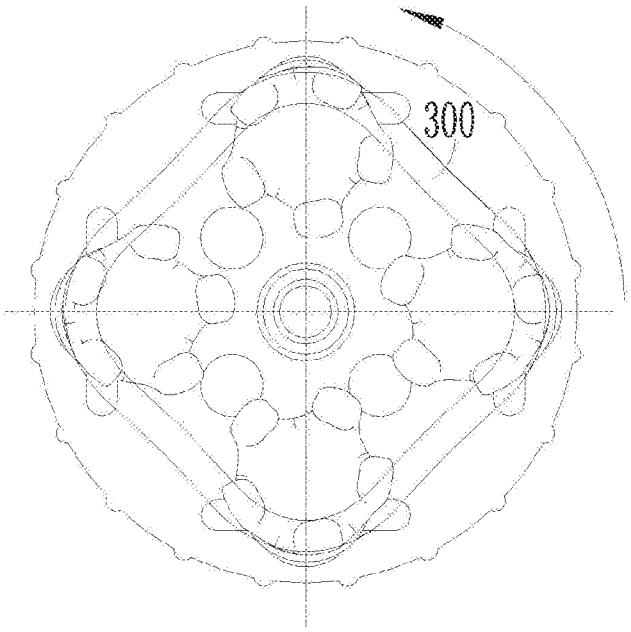

As shown in FIG. 7A and FIG. 7B, when the moving rail 300 is rotated to the first position P1 of the moving rail 300 in correspondence to the respective connecting part 510, the inner wall of the moving rail 300 pushes against the top of the connecting part 510, such that the massage claw 520 swings inwardly, and each of the massage claws 520 are in the first extreme position, and thereby the claw massage apparatus is presented in a grasping state.

Figure 8A:
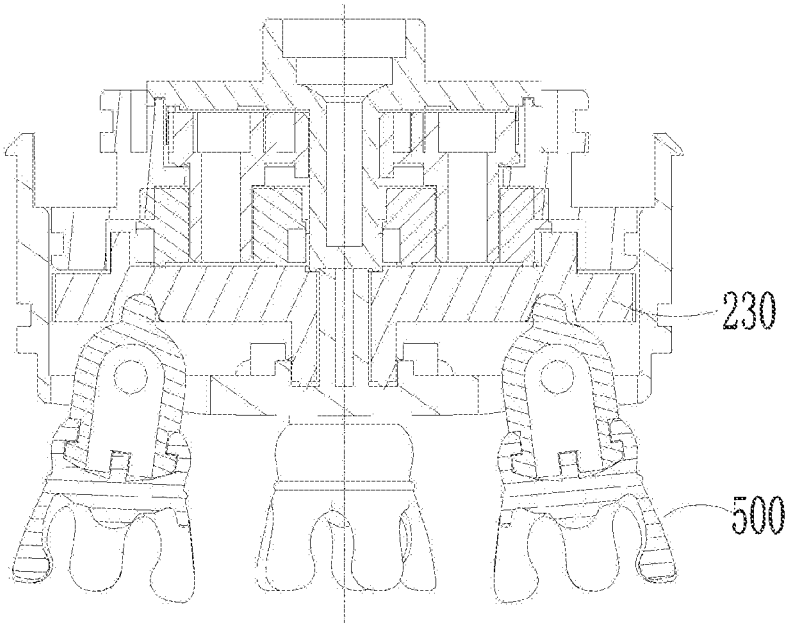
FIG. 8*a* and FIG. 8*b* are respectively a cross-sectional vies and a bottom view of the claw massage apparatus according to the first embodiment of the present disclosure, showing that the massage claw is in a second extreme position.
Figure 8B:
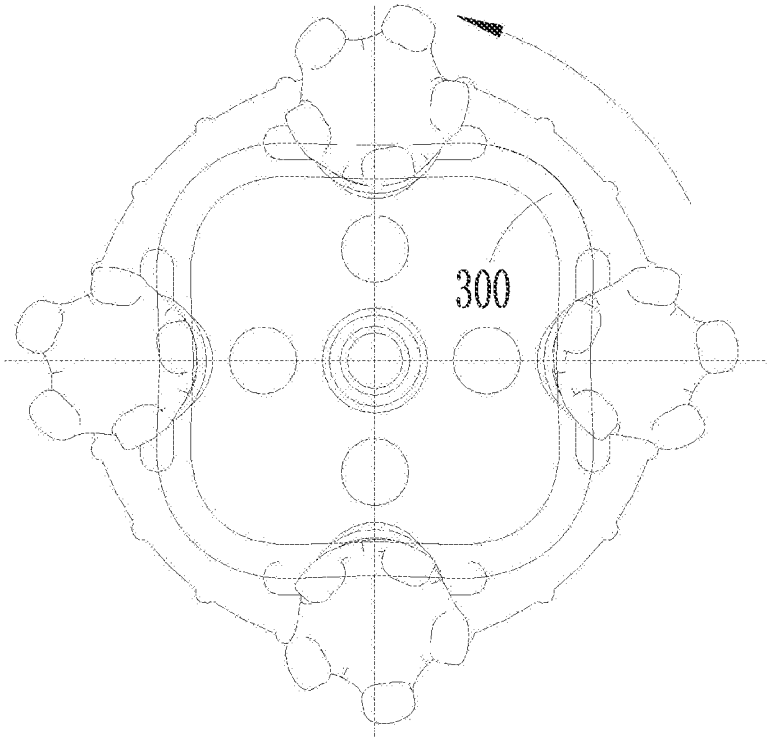

As shown in FIG. 8A and FIG. 8B, when the moving rail 300 is rotated to the second position P2 of the moving rail 300 in correspondence to the respective connecting part 510, the inner wall of the moving rail 300 pushes against the top of the connecting part 510, such that the massage claw 520 swings outwardly, and each of the massage claw 520 are in the second extreme position, and thereby the claw massage apparatus is presented in an opening state.

During the rotation of the moving rail 300, the respective massage claws 520 will alternately swing between the first extreme position and the second extreme position to complete a continuous grasping massage action.

In this embodiment, there are four first positions P1 and four second positions P2. The number of the massage mechanisms 500 is the same as the number of the first positions P1 and the second positions P2, and are evenly distributed. All the massage claws 520 of the massage mechanisms 500 may simultaneously be at the first extreme position or at the second extreme position. During a counterclockwise rotation of the moving rail 300, each of the massage claws 520 changes the grasping state once with each rotation in 45 degrees.

Figure 9:
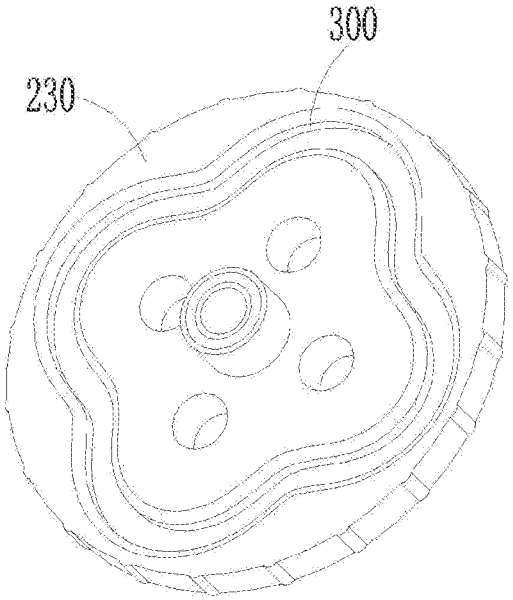
FIG. 9 and FIG. 10 are respectively a perspective view and a top view of another embodiment of a track disk of the claw massage apparatus according to the first embodiment of the present disclosure.
Figure 10:
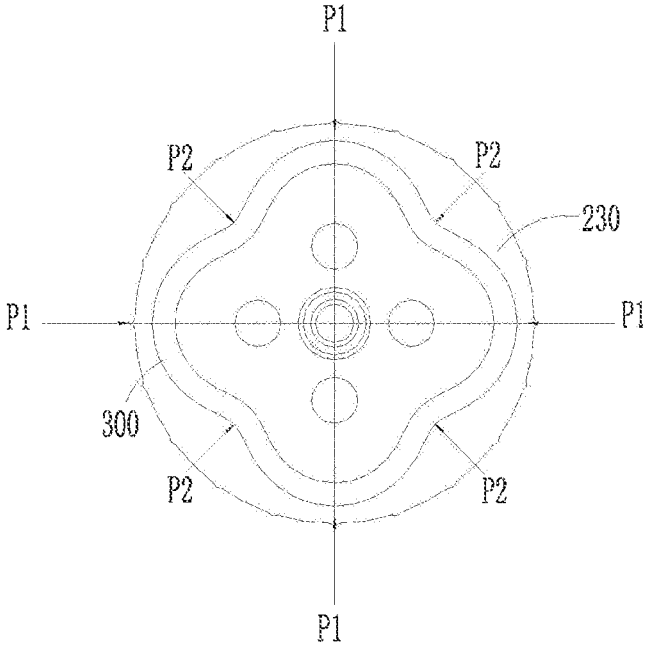

It should be understood that the shape of the moving rail 300 is not limited to an annular square structure, but also may be other regular polygons. For example, as shown in FIG. 9 and FIG. 10, the moving rail 300 is generally in the shape of a quincunx, the first positions P1 are positioned at the four apex angles of the moving rail 300, and the second positions P2 are positioned at the midpoint between the adjacent apex angles of the moving rail 300.

Figure 11:
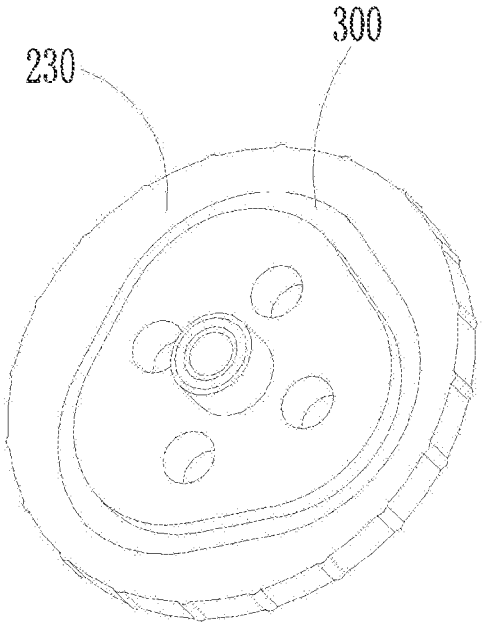
FIG. 11 and FIG. 12 are respectively a perspective view and a top view of a farther embodiment of the track disk of the claw massage apparatus according to the first embodiment of the present disclosure.
Figure 12:
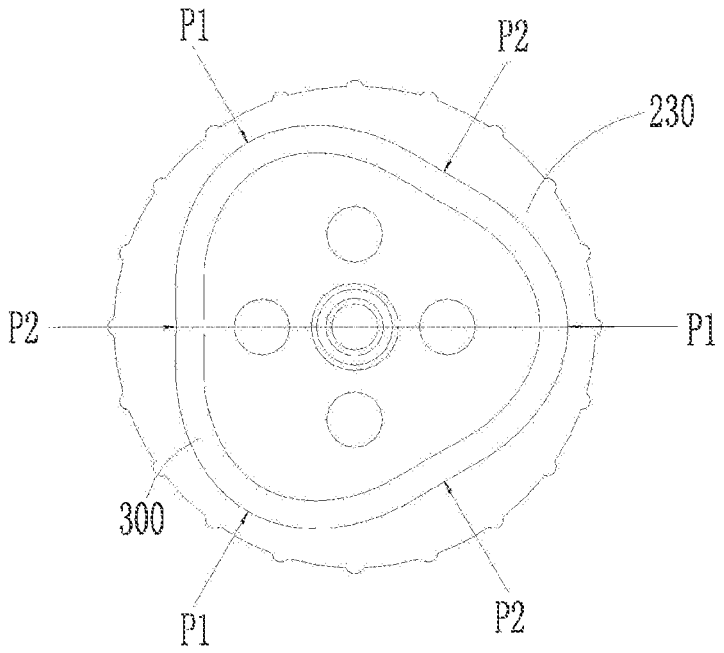

Alternatively, for example, as shown in FIG. 11 and FIG. 12, there are three first positions P1 and three second positions P2 of the moving rail 300, the first positions P1 are positioned at three apex angles of the moving rail 300, and the second positions P2 are positioned at the midpoint between adjacent apex angles of the moving rail 300.

It should be understood that the number of the first positions P1 and the second positions P2 is not limited thereto. The number of the first positions P1 and the second positions P2 is an even number and greater than or equal to two. Alternatively, the number of the first positions P1 and the second positions P2 is an odd number and is greater than or equal to three. The number of the massage mechanisms 500 may be identical to or different from the number of the first positions P1 and the second positions P2. For example, the number of each of the first positions P1 and the second positions P2 is four, and the number of the massage mechanisms 500 may be two or three or four. The number may be appropriately increased or decreased as needed, and an appropriate arrangement may be selected, and various variations of the numbers and changes of the layout are encompassed within the scope for protection of the present disclosure.

In this embodiment, as shown in FIG. 2, the connecting part 510 of the massage mechanism 500 includes a connecting body 511 and a first connecting post 512. The first connecting post 512 protrudes from the top of the connecting body 511 along an axis and may be accommodated in the moving rail 300.

The massage claw 520 includes a first connecting sleeve 521 and a claw body 522. The first connecting sleeve 521 is secured to an upper end of the claw body 522 and is sleeved with the connecting body 511. The claw body 522 is positioned outside the base 400. The first connecting sleeve 521 may be made of a flexible material, such as a silicone. A flange is provided on the lower end of the connecting body 511 and may be sleeved in the first connecting sleeve 521. The first connecting sleeve 521 is squeezed such that the claw body 522 may be slightly moved, so as to improve the massage comfort. It should be understood that the structures of the connecting part 510 and the massage claw 520 are not limited thereto, and also may be formed integrally. Any mechanical connection that enables the connection of the connecting part 510 and the massage claw 520 is applicable to the present disclosure.

Figure 5:
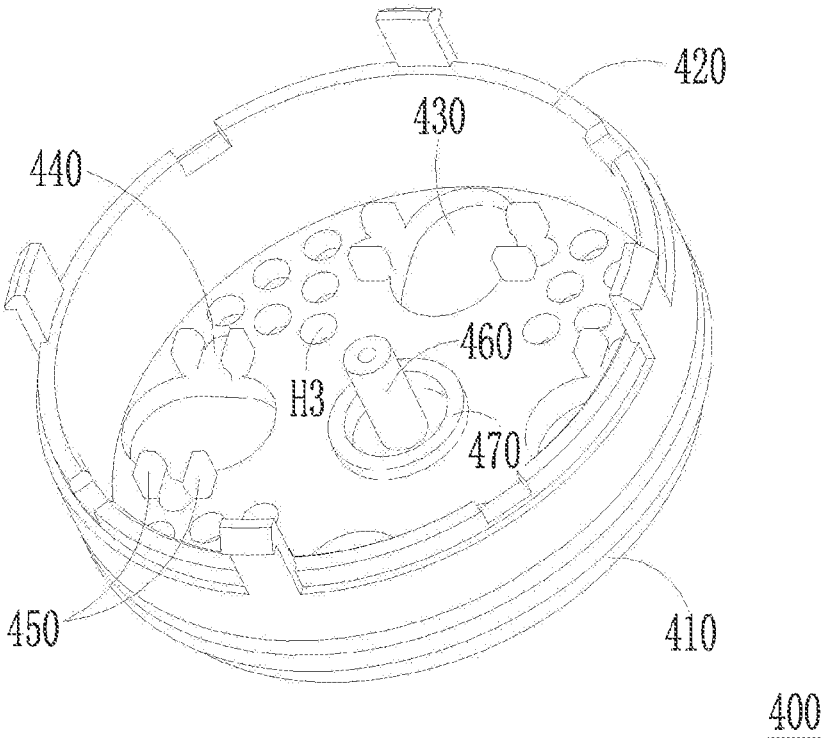
FIG. 5 is a perspective view of a base of the claw massage apparatus according to the first embodiment of the present disclosure.

In this embodiment, as shown in FIG. 2 and FIG. 5, the connecting part 510 may further include a second connecting post 513, which protrudes from an outer circumference of the connecting body 511 in a radial direction. The base 400 includes a bottom plate 410 and a convex ring 420 connected to the outer circumference of the bottom plate 410. The convex ring 420 may be provided with a plurality of connection buckles for connecting with other devices, such as a shower.

A plurality of through holes 430 are defined in the base 400. A recess 440 and a pair of blocks 450 are provided adjacent to each of the through holes. The recess 440 is located between the pair of blocks 450. The connecting body 511 is movable through the through hole 430. The second connecting post 513 may be movably disposed in the recess 440. During the first connecting post 512 is pushed to move by the edge of the moving rail 300, the respective connecting parts 510 swing synchronously around the second connecting post 513, so that the respective massage claws 520 are close to or away from each other. When the first connecting post 512 is in the first position P1, the massage claw 520 is in the first extreme position, and when the first connecting post 512 is in the second position P2, the massage claw 520 is in the second extreme position.

Therefore, the second connecting post 513 is stably supported by the recess 440, and the second connecting post 513 may be limited by the pair of blocks 450 on both sides of the recess 440, thereby ensuring stable and accurate swinging of the connecting part 510.

In this embodiment, the outer circumference of the connecting body 511 may have a circular cross section, the through hole 430 is a long hole, and the through hole is close to the outer circumference of the bottom plate 410. Therefore, the substantially cylindrical connecting body 511 may swing within a range defined by the through hole 430. Since the through hole 430 is a long hole, the connecting body 511 is allowed to swing within a larger range.

In this embodiment, as shown in FIG. 2, a first water outlet H1 is provided between the adjacent two blades 112 on the wheel body 111. A second water outlet H2 passing through the transmission mechanism 200 is provided between the center of the rail plate 230 and the moving rail 300. As shown in FIG. 5, a third water outlet H3 is provided passing through the base 400. The water may sequentially flow into the first water outlet H1, the second water outlet H2, and the third water outlet H3 through the water inlet holes 121 and flow out of the claw massage apparatus.

As shown in FIG. 2, FIG. 4 and FIG. 5, the claw massage apparatus may further include a hole cover 600. The hole cover 600 includes a cover body 610 and a cylinder 620 disposed centrally on one surface of the cover body 610. A shaft hole 114 is provided passing through the wheel body 111 at a center of the wheel body 111 of the impeller 110. A rib is provided on the inner edge of the upper cover 120. A hollow second connecting sleeve 231 is provided at a center of the rail plate 230. A connecting post 460 that protrudes toward the interior of the claw massage apparatus is provided at the center of the bottom plate 410 of the base. The impeller 110 is supported on the rib. The cylinder 620 passes through the shaft hole 114 of the impeller 110. The cover body 610 is snap-fitted on the top of the upper cover 120. And the connecting post 460 is disposed through the second connecting sleeve 231.

As shown in FIG. 4, a first step portion 232 is concaved around the outer circumference of the second connecting sleeve 231 on one surface of the rail plate 230, and an inner circumference of the first step portion 232 radially limits the end portion of the cylinder 620. A second step portion 470 is provided around the outer circumference of the connecting post 460 on one surface of the bottom plate 410, and the inner circumference of the second step portion 470 radially limits the end portion of the second connecting sleeve 231.

Therefore, the claw massage apparatus of this embodiment is assembled as a whole by means of the above structures, which has a compact structure, a firm connection, and a strong stability.

The Second Embodiment

This embodiment is different from the first embodiment mainly in the form of the rail plate.

Figure 13:
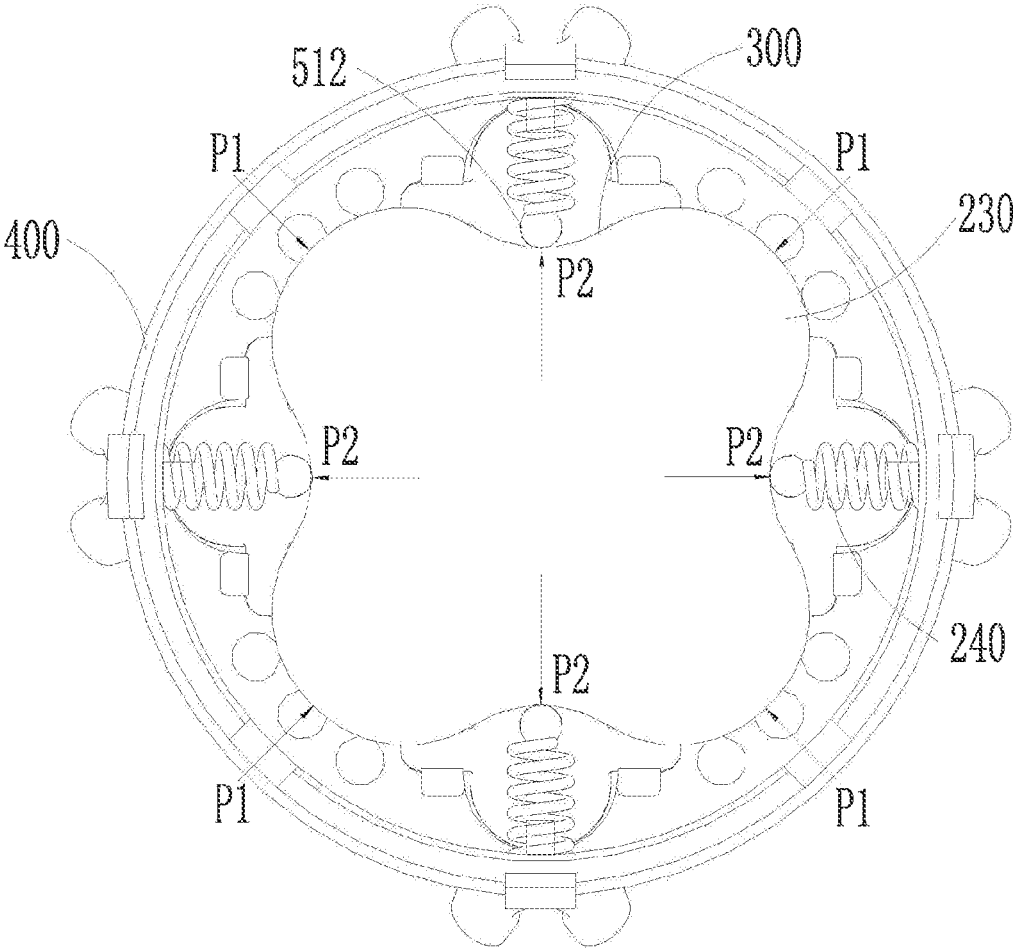
FIG. 13 is a top view of a portion of the claw massage apparatus according to the second embodiment of the present disclosure.

Particularly, as shown in FIG. 13, the rail plate 230 is in the form of a cam, and has a curved side on the outer circumference thereof, which serves as the moving rail 300. The moving rail 300 has a first position P1 and a second position P2. A distance between the first position P1 and a center of the moving rail 300 is the maximum distance, and a distance between the second position P2 and a center of the moving rail 300 is the minimum distance. In this embodiment, the number of each of the first positions P1 and the second positions P2 is four.

The outer circumference of the first connecting post 512 of the massage mechanism is closely attached to the outer circumference of the rail plate 230. During the rotation of the rail plate 230, the first connecting post 512 is pushed by the edge of the moving rail 300 to move, to drive the respective connecting parts 510 to swing synchronously around the second connecting post 513, such that the respective massage claws 520 are close to or away from each other. When the first connecting post 512 is in the first position P1, the massage claw 520 is in the first extreme position, and when the first connecting post 512 is in the second position P2, the massage claw 520 is in the second extreme position.

In this embodiment, elastic members 240, such as tension springs, are disposed on the inner circumference of the base 400 and abut against the first connecting posts 512, respectively. As the moving rail 300 rotates, the first connecting post 512 gradually approaches to the first position P1, and gradually compresses the elastic members 240. When the respective first connecting posts 512 are in the first positions P1, the elastic members 240 are compressed to a certain extent, to accumulate an elastic restoring force toward the center of the moving rail 300 for the respective first connecting post 512. When the rail plate continues to rotate, and the first connecting posts 512 leave the first positions P1, the first connecting post 512 is pushed by the elastic restoring force of the elastic member 240 and closely attached to the outer circumference of the rail plate 230. Therefore, the elastic member 240 is provided such that the first connecting posts 512 are always at the moving rail 300, and after leaving the first positions P1, still closely attached to the outer circumference of the rail plate 230, to realize a smooth and free grasping motion of the massage claw 520.

It should be understood that the shape of the cam is not limited thereto, and various shapes of moving rails as described in the first embodiment may be applied to this embodiment.

In addition, the transmission mechanism as described in the first embodiment may be applied to this embodiment to drive rotation of the cam. For example, a gear ring is provided on one side of the cam to engage with the gear of the transmission mechanism, alternatively, the cam is directly connected to the impeller in a transmission way.

In summary, in the claw massage apparatus of the present disclosure the massage mechanism swings due to rotation of the moving rail, such that the respective massage claws simultaneously move inwardly or outwardly, and finally the grasping motion is realized. Compared with the rotary massage in the related art, the claw massage apparatus of the present disclosure may simulate an effect of manual grasping massage, and the massage power is appropriate, which may promote blood circulation and bring relaxation for the user.

Although the present disclosure has been described with reference to a few of exemplary embodiments, it should be understood that all the terms used are illustrative and exemplary, and nonrestrictive. As the present disclosure may be embodied in a variety of forms without departing from the spirit or scope of the invention, it is to be understood that die above-described embodiments are not limited to any foregoing detail. All changes and modifications within the scope of the claims or their equivalents are intended to be embraced by the appended claims.

What is claimed is:

1. A claw massage apparatus comprising:

a drive mechanism, comprising an impeller and an upper cover; the impeller comprises a wheel body and blades disposed on the wheel body, and the wheel body is connected to a transmission mechanism in a transmission way; the upper cover is disposed around the impeller, and is provided with water inlet holes in communication with the impeller; a water flow is able to enter the impeller through the water inlet holes, and flush the blades to rotate the impeller, so as to drive rotation of the transmission mechanism;

the transmission mechanism is configured to be driven by the drive mechanism to rotate, and the transmission mechanism being provided with a moving rail, the transmission mechanism comprising a rail plate that is driven by the drive mechanism to rotate, and the rail plate defines a motion track;

a base to which the transmission mechanism is rotatably connected;

a plurality of massage mechanisms, which are supported by the base, each of the massage mechanisms comprising a connecting part connected to the moving rail in the transmission way and a massage claw positioned outside the base;

wherein the drive mechanism is configured to drive rotation of the moving rail, wherein an outer circumference of the rail plate forms the moving rail; the connecting part of the massage mechanism comprises a connecting body and a first connecting post, and the first connecting post is protruded along an axis at a top of the connecting body; the massage claw comprises a first connecting sleeve and a claw body; the first connecting sleeve is fixed to an upper end of the claw body and is sleeved with the connecting body, and the claw body is positioned outside the base; an outer circumference of the first connecting post is closely attached to the outer circumference of the rail plate, during the rotation of the rail plate, the first connecting post is pushed by the outer circumference of the rail plate to move to drive the respective connecting parts to synchronously swing, so that the respective massage claws are close to or away from each other, such that the respective massage claws move between a first extreme position and a second extreme position; in the first extreme position, the respective massage claws are close to each other; in the second extreme position, the respective massage claws are distanced from each other; and tension springs, which are disposed on the inner circumference of the base and abut against the first connecting posts, respectively; as the moving rail rotates, the first connecting post gradually approaches to the first position, and gradually compresses the tension springs; when the respective first connecting posts are in the first positions, the tension springs are further compressed, to accumulate an elastic restoring force toward a center of the moving rail for the respective first connecting post.

2. The claw massage apparatus of claim 1, wherein the impeller further comprises guide posts, and the guide posts and the blades are respectively disposed on opposite surfaces of the wheel body; the transmission mechanism further comprises a gear and a gear ring, and the gear is provided with a through shaft hole through which the guide post passes; the gear engages with internal teeth of the gear ring; the gear ring is fixed to one surface of the rail plate; the moving rail is recessed on the other surface of the rail plate; during rotation of the impeller, the guide posts drive the gear and the gear ring engaged with the gear to rotate, so as to rotate the moving rail.

3. The claw massage apparatus of claim 2, wherein a number of each of the guide posts and gears is two, the guide posts are disposed in a direction of a diameter of the wheel body, and the impeller is rotated about a central axis.

4. The claw massage apparatus of claim 1, wherein a distance between the first position and a center of the moving rail is the maximum distance, and a distance between the second position and the center of the moving rail is the minimum distance; the massage claw is in the first extreme position when the moving rail rotates to the second position of the moving rail in correspondence to the respective connecting part; and the massage claw is in the second extreme position when the moving rail rotates to the second position of the moving rail in correspondence to the respective connecting part.

5. The claw massage apparatus according to claim 4, wherein the first position and the second position are the same in number and are separately arranged in plural; a number of the massage mechanisms is the same as the number of the first positions and the second positions, and are evenly distributed; the massage claws of the massage mechanisms are configured to simultaneously be at the first extreme position or at the second extreme position.

6. The claw massage apparatus of claim 5, wherein the number of the first positions and the second positions is an even number and greater than or equal to two.

7. The claw massage apparatus of claim 5, wherein the number of the first positions and the second positions is an odd number and is greater than or equal to three.

8. The claw massage apparatus of claim 5, wherein the moving rail is a centrally symmetrical shape and the moving rail has a smooth corners.

9. The claw massage apparatus of claim 4, wherein the connecting part further comprises a second connecting post, which protrudes from an outer circumference of the connecting body in a radial direction; the base comprises a bottom plate and a ring connected to the outer circumference of the bottom plate; a plurality of through holes are defined in the base; a recess and a pair of blocks are provided adjacent to each of the through holes; the recess is positioned between the pair of blocks; the connecting body is movable through the through hole; the second connecting post is movably disposed in the recess; during the first connecting post is pushed to move by the edge of the moving rail, the respective connecting parts swing synchronously around the second connecting post, so that the respective massage claws are close to or away from each other; when the first connecting post is in the first position, the massage claw is in the first extreme position, and when the first connecting post is in the second position, the massage claw is in the second extreme position.

10. The claw massage apparatus of claim 9, wherein the outer circumference of the connecting body has a circular cross section, the through hole is close to the outer circumference of the bottom plate.

11. The claw massage apparatus of claim 2, wherein a first water outlet is provided between the adjacent two blades on the wheel body; the gear ring and the rail plate are integrally formed, and a second water outlet is provided between the center of the rail plate and the moving rail; the base is provided with a third water outlet; the water can sequentially flow into the first water outlet, the second water outlet, and the third water outlet through the water inlet holes and flow out of the claw massage apparatus.

12. The claw massage apparatus of claim 9, wherein the claw massage apparatus further comprises a hole cover including a cover body and a cylinder that is disposed centrally on one surface of the cover body; a through shaft hole is provided at a center of the wheel body of the impeller; ribs are provided on an inner edge of the upper cover; a second connecting sleeve is hollow and provided at the center of the rail plate; the second connecting post protrudes toward an interior of the claw massage apparatus at the center of the bottom plate of the base; the impeller is supported on the rib, and the cylinder passes through the shaft hole of the impeller, the cover body is snap-fitted to the top of the upper cover, and the second connecting post is disposed through the second connecting sleeve.

13. The claw massage apparatus of claim 12, wherein a first step portion is provided around the outer circumference of the second connecting sleeve on one surface of the rail plate, and an inner circumference of the first step portion radially limits an end portion of the cylinder; and a second step portion is provided around the outer circumference of the connecting post on one surface of the bottom plate, and an inner circumference of the second step portion radially limits an end portion of the first connecting post.

* * * * *